US005298913A

United States Patent [19]

Numao et al.

[11] Patent Number: 5,298,913

[45] Date of Patent: Mar. 29, 1994

[54] FERROELECTRIC LIQUID CRYSTAL DISPLAY DEVICE AND DRIVING SYSTEM THEREOF FOR DRIVING THE DISPLAY BY AN INTEGRATED SCANNING METHOD

[75] Inventors: Takazi Numao, Tenri; Kunihiko Yamamoto, Nara, both of Japan

[73] Assignee: Sharp Kabushiki Kaisha, Osaka, Japan

[21] Appl. No.: 879,459

[22] Filed: May 4, 1992

Related U.S. Application Data

[63] Continuation of Ser. No. 569,365, Aug. 15, 1990, abandoned, which is a continuation of Ser. No. 200,514, May 26, 1988, abandoned.

[30] Foreign Application Priority Data

May 29, 1987 [JP] Japan ..... 62-133816

[51] Int. Cl.[5] ..... G09G 3/36

[52] U.S. Cl. ..... 345/97; 345/100

[58] Field of Search ..... 340/765, 784, 805, 811, 340/804; 358/17, 152, 160, 88, 92; 359/56; H04N 5/06, 5/12

[56] References Cited

U.S. PATENT DOCUMENTS

| | | | |
|---|---|---|---|
| 2,295,023 | 9/1942 | Beatty et al. | 358/17 |
| 3,903,358 | 9/1975 | Roese | 358/92 |
| 3,983,328 | 9/1976 | Newell | 358/160 |
| 4,275,421 | 6/1981 | Louie et al. | 340/784 |
| 4,307,421 | 12/1981 | Smit | 358/152 |
| 4,317,115 | 2/1982 | Kawakami et al. | 340/784 |
| 4,386,367 | 5/1983 | Peterson et al. | 358/152 |
| 4,660,030 | 4/1987 | Maezawa | 340/784 |
| 4,679,043 | 7/1987 | Morokawa | 340/784 |
| 4,772,943 | 9/1988 | Nakagawa et al. | 358/88 |
| 4,778,260 | 10/1988 | Okada et al. | 340/765 |
| 4,816,816 | 3/1989 | Usui | 340/784 |
| 4,816,819 | 3/1989 | Enari et al. | 340/784 |
| 4,840,462 | 6/1989 | Hartmann | 340/784 |

FOREIGN PATENT DOCUMENTS 0177247 4/1986 European Pat. Off. .

OTHER PUBLICATIONS

F. H. Dill, "High Resolution NTSC Television System", IBM Technical Disclosure Bulletin, vol. 21, No. 5, Oct. 1978, pp. 2148-2153.

*Primary Examiner*—Richard Hjerpe

[57] ABSTRACT

A ferroelectric liquid crystal display device is disclosed, which takes a specified period to rewrite the picture elements in one horizontal scanning period, and includes M scanning lines divided into a plurality of groups each containing K scanning lines (K>1, M>1, K, M: positive integers) and elements for supplying scanning signals to the M scanning lines to rewrite an image. The scanning signal-supplying elements output scanning signals to the first scanning line of each group in the first frame, to the second scanning line of each group in the second frame, and to the Kth scanning line of each group in the Kth frame so that the M scanning lines are rewritten by K times of scanning.

6 Claims, 5 Drawing Sheets

FIG. 6 (1)
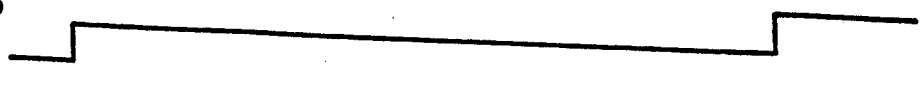
FIG. 6 (2)
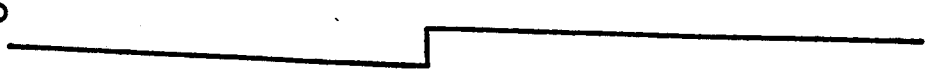
FIG. 6 (3)
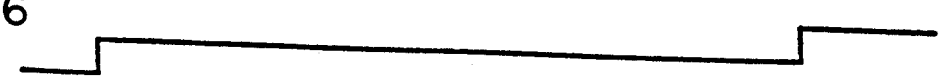
FIG. 6 (4)
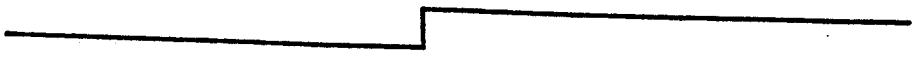
FIG. 6 (5)
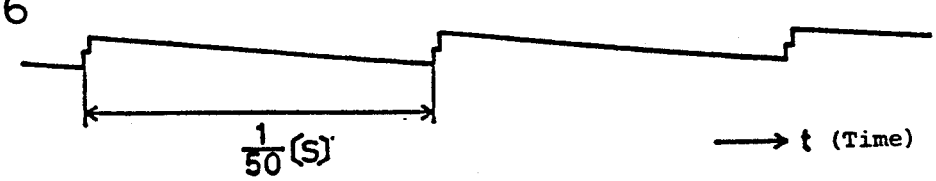
FIG. 7 (1)
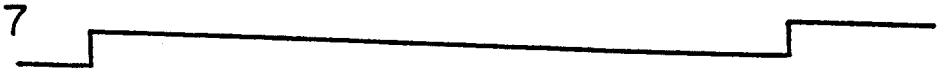
FIG. 7 (2)
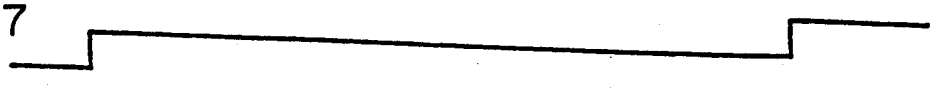
FIG. 7 (3)
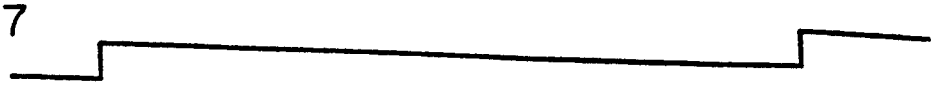
FIG. 7 (4)
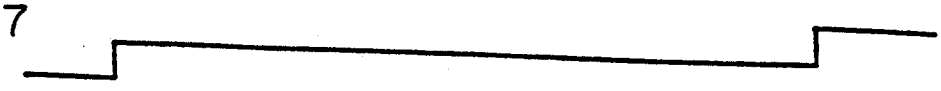
FIG. 7 (5)
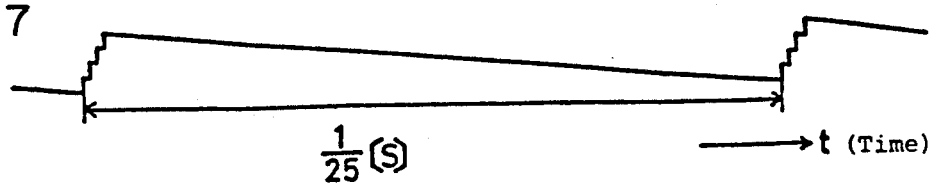

FERROELECTRIC LIQUID CRYSTAL DISPLAY DEVICE AND DRIVING SYSTEM THEREOF FOR DRIVING THE DISPLAY BY AN INTEGRATED SCANNING METHOD

This application is a continuation of application Ser. No. 07,569,365 filed on Aug. 15, 1990, now abandoned which is a continuation of Ser. No. 07,200,514 filed May 26, 1988, now abandoned.

BACKGROUND OF THE INVENTION

The present invention relates to a display device or more particularly to a display device having such an incomplete memory characteristic as that of ferrodielectric liquid crystal and which takes a specified time to rewrite the picture elements. The invention further relates to a driving system of the display device.

Ferrodielectric liquid crystal is a well-known element with incomplete memory characteristic. When a picture is to be displayed on a matrix type display panel that uses ferrodielectric liquid crystal, video signals are sent from, for example a personal computer to the display panel. Since the video signals from the personal computer are non-interlace signals, however, it is not possible to use all frames of the signals in displaying the picture on the panel because of the time restriction for rewriting by the ferrodielectric liquid crystal. Conventionally, therefore, a picture is displayed by using, for instance, every other frame of the video signals.

Assuming that the number of scanning lines M of a video signal sent from a personal computer is 200 and that the time required by the liquid crystal for rewriting the picture elements in one horizontal scanning period is 200 μs, the frame frequency fF on the screen is calculated as:

$$fF = \frac{1}{f \times M} = \frac{1}{200 \times 10^{-6} \times 200} = 25 \text{ Hz.}$$

If the memory characteristic of the liquid crystal is incomplete, when a figure "1" is kept written, the luminance of the image changes little by little after the figure is rewritten, as shown in FIGS. 7(1), 7(2), 7(3) and 7(4). For instance, the luminance of the picture elements on the lines $L_1$, $L_2$, $L_3$ and $L_4$ changes as shown in FIGS. 7(1), 7(2), 7(3) and 7(4), respectively. The combined luminance of the 4 (vertical)×4 (horizontal) picture elements changes at 25 Hz as shown in FIG. 7(5). Since human eyes can sense the luminance variation at a frequency not higher than 60 Hz, the above luminance change is sensed as a flicker so that the picture quality is deteriorated.

SUMMARY OF THE INVENTION

An object of the present invention is to solve the abovementioned problem by providing a display device and its driving system which improves the display picture quality by controlling the operation of rewriting the picture elements.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above object, according to an embodiment of the present invention, a display device, which provides an incomplete memory characteristic and takes "r" seconds to rewrite the picture elements in one horizontal scanning period, comprises "M" scanning lines divided into a plurality of groups each containing "K" scanning lines (K>1, M>1, K, M=positive integers), and a device for sending scanning signals to the "M" scanning lines so as to rewrite a picture. The scanning signal sending device sends scanning signals to the first scanning line in each scanning line group in the first frame, to the second scanning lines in each scanning line group in the second frame, and to the "K"th scanning line in each scanning line group in the "K"th frame so that the picture elements on the "M" scanning lines are rewritten by "K" times of scanning.

The present invention is effective for the condition of $$60 > \frac{1}{r \times M}$$

in which "r" is the time required for rewriting the picture elements in one horizontal scanning period.

The action of the present invention is described in the following, assuming K=2, M=200 and r=200 μs for simplification.

In the first frame, the scanning lines of odd number 1, 3, 5, . . . , 199 are scanned, and in the second frame the scanning lines of even number 2, 4, 6, . . . , 200 are scanned, thus completing an entire picture in two frames. Specifically, picture signals input to the display device contain 200 effective scanning lines in one frame. However, all of these 200 effective lines are not used for each frame. For the first frame, the signals for scanning lines of odd number alone are used while those for scanning lines of even number are discarded. For the second frame, the signals for scanning lines of an even number alone are used while those for scanning lines of an odd number are discarded. As a result, picture elements are written at 50 Hz on the display panel, compared with 25 Hz by the conventional device. This results in less conspicuous flicker of a picture.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIGS. 6(1)–6(5) are charts for explaining the effect of the present invention; and FIGS. 7(1)–7(5) are charts for explaining the conventional device.

DETAILED DESCRIPTION OF THE EMBODIMENTS

Figure 1:
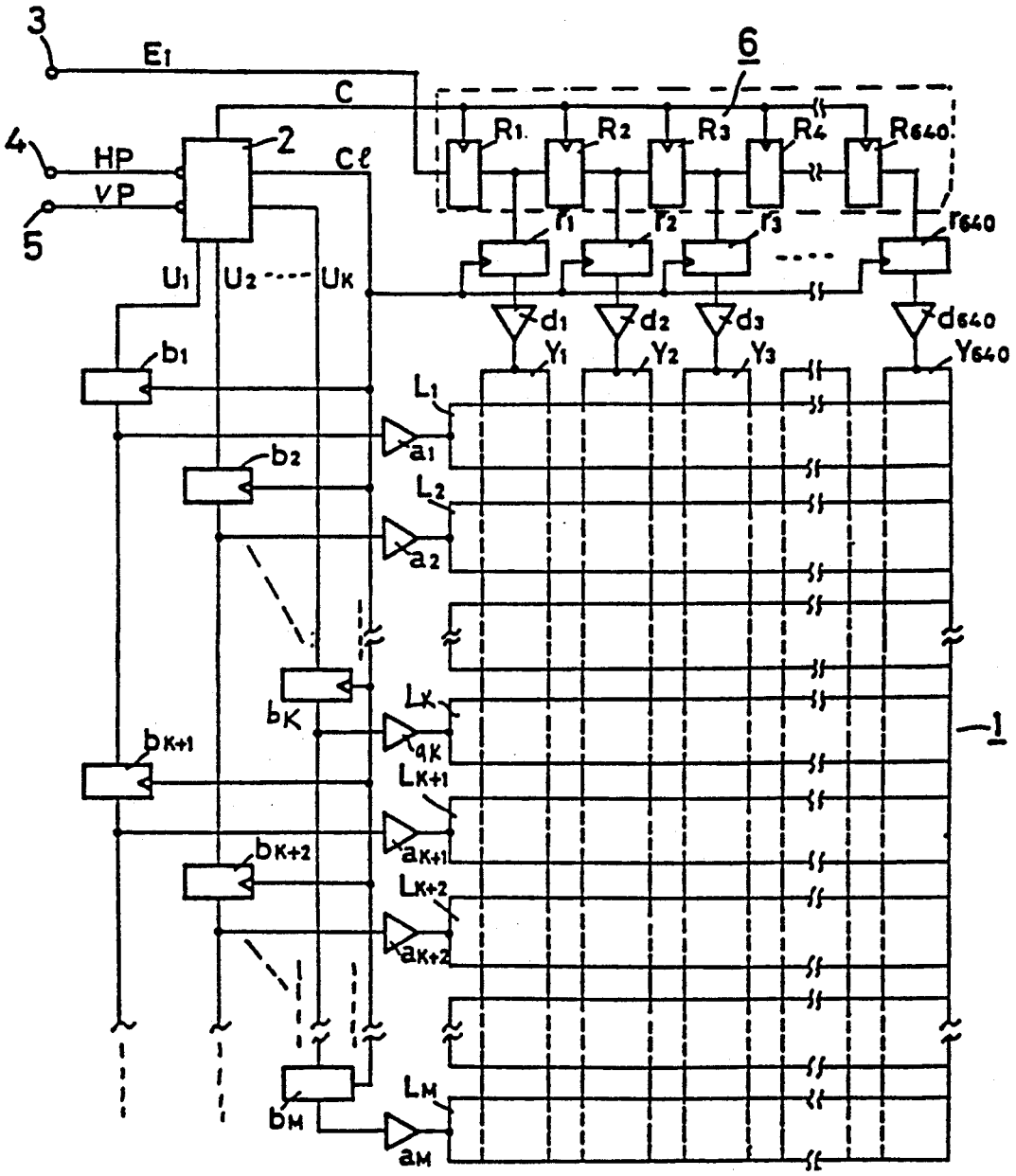
FIG. 1 is a circuit diagram showing the construction of the display device of a first embodiment of the present invention.

According to an embodiment of the present invention, a display device such as an X-Y matrix type liquid crystal display panel contains a pair of insulating substrates with a liquid crystal layer sandwiched therebetween. "M" scanning electrodes are provided on the inner side of one of the substrates, and "N" signal electrodes on the inner side of the other substrate, the scanning electrodes crossing the signal electrodes at right angles. The display device of the present invention provides an incomplete memory characteristic and takes "r" seconds to rewrite the picture elements in one horizontal scanning period. An example of a substrate with an incomplete memory characteristic is a ferrodielectric liquid crystal. The insulating substrate of the display device may be made of a conducting member with an insulating film formed thereon or made of a conducting member alone. The insulating substrates having scanning electrodes and signal electrodes respectively are covered with insulating films, respectively. An effective display region is realized by the "M" scanning electrodes and the "N" signal electrodes.

The present invention is characterized in the following features.

The "M" scanning electrodes are divided into "P" groups each containing "K" scanning electrodes ($K>1$, $P>1$, K, P=integers). By the first frame, all the first scanning electrodes in all groups are scanned sequentially. Then by the second frame, all the second scanning electrodes in all groups are scanned sequentially. This process is repeated until all the "K"th scanning electrodes in all groups have been scanned by the "K"th frame. Namely, "P" scanning electrodes are scanned sequentially by each frame. This scanning process is repeated "K" times to scan "M" scanning electrodes, thus rewriting the picture elements for one picture.

If "M" cannot be divided by "K", at least one of the "P" groups may contain fewer than "K" electrodes. Preferably, every group should contain the same number of electrodes.

With $K=2$, for instance, every other scanning line is rewritten by each frame. With $K=3$, every third scanning line is rewritten by each frame.

The present invention is effective particularly for the condition of $$60 > \frac{1}{r \times M}.$$

In the following description, the display device is assumed to be an X-Y matrix type liquid crystal display panel in which the number of scanning electrodes "M"=200, and the number of signal electrodes "N"=640. It is not intended that the present invention is limited to the above; the number of electrodes "M" and "N" may be changed as desired.

In the X-Y matrix liquid crystal display panel 1 of the present invention, signal electrodes $Y_1, Y_2, \ldots Y_{N=640}$ are provided on the first insulating substrate, and scanning electrodes $L_1, L_2, \ldots L_{M=200}$ on the second insulating substrate. The signal electrodes and the scanning electrodes are covered with insulating films for insulation between the electrodes. A ferrodielectric liquid crystal layer (such as CS-1014 by Chisso Corporation) is placed between the first and second insulating substrates.

Image data to be supplied to the signal electrodes $Y_1, Y_2, \ldots Y_{640}$ is sent in form of input signals Ei through a terminal 3 to a shift register 6 which comprises D flip flops $R_1, R_2, \ldots R_{640}$ corresponding to the signal electrodes respectively. The input signals Ei are applied to the data terminals of the D flip flops $R_1, R_2, \ldots R_{640}$. A basic clock pulse signal C is supplied from a converter circuit 2 to the clock terminals of the D flip flops $R_1, R_2, \ldots R_{640}$ so that data signals are output sequentially from the D flip flops $R_1, R_2, \ldots R_{640}$ in this order. The data signals thus output pass through D flip flops $r_1, r_2, \ldots r_{640}$ and drivers $d_1, d_2, \ldots d_{640}$ and are input to the signal electrodes $Y_1, Y_2, \ldots Y_{640}$. Horizontal clock pulse signals cl are supplied as clock signals to the D flip flops $r_1, r_2, \ldots r_{640}$.

Here, the image data or video signals contains "M" scanning electrodes or scanning lines in one frame. When a picture is to be rewritten by "K" frames, the same image signals are supplied "K" times.

Figure 2:
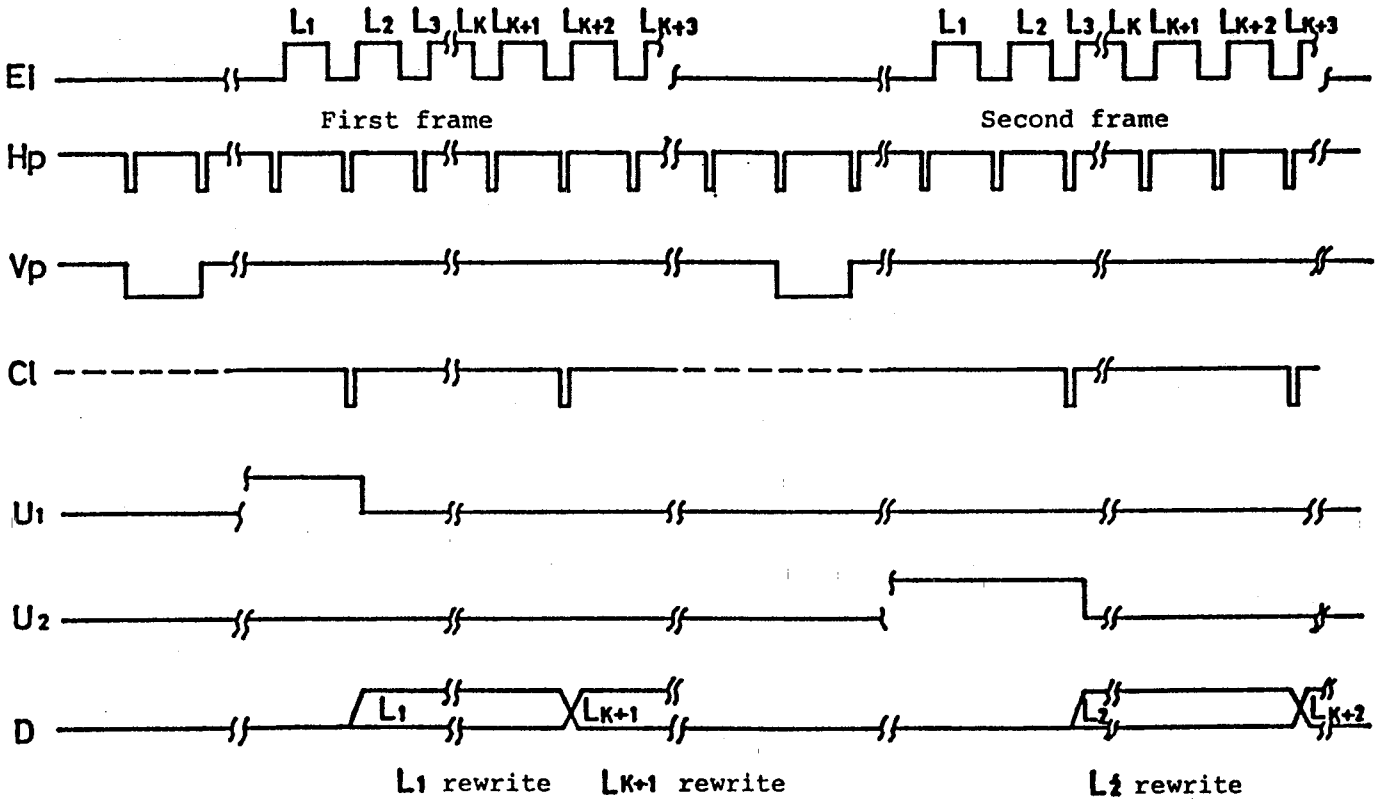
FIG. 2 is a chart of signal waveform in each part thereof.

Using horizontal synchronizing pulse HP and vertical synchronizing pulse VP that are input through terminals 4 and 5, a converter circuit 2 generates basic clock pulse signal C and horizontal clock cl. The converter circuit 2 also generates selection signals $U_1, U_2, \ldots U_K$ for selecting one of the 1st to the "K"th electrodes of each group. One of the selection signals $U_1, U_2, \ldots U_K$ becomes high in each frame, the selection signal of high level changes in the order of $U_1, U_2, \ldots U_K$ as a frame changes. Specifically, the selection signal $U_1$ becomes high in the first frame, and the selection signal $U_2$ becomes high in the second frame as shown in FIG. 2. And eventually, the selection signal $U_K$ becomes high in the Kth frame (not shown).

Receiving the selection signal $U_1$ and the horizontal clock pulse signal cl, D flip flops $b_1, b_{K+1}, \ldots$ supply rewrite signals through drivers $a_1, a_{K+1}, \ldots$ to the scanning electrodes $L_1, L_{K+1}, \ldots$. Similarly, receiving the selection signal $U_2$ and the horizontal clock pulse signal Cl, D flip flops $b_2, b_{K+2}, \ldots$ supply rewrite signals through drivers $a_2, a_{K+2}, \ldots$ to the scanning electrodes $L_2, L_{K+2}, \ldots$. With the selection signal $U_K$ as well, rewrite signals are supplied to the specified scanning electrodes. Namely, on receiving the selection signal $U_K$ and the horizontal clock pulse signal Cl, D flip flops $b_K, b_{2K}, \ldots b_M$ supply rewrite signals through drivers $a_K, a_{2K}, \ldots$ to the scanning electrodes $L_K, L_{2K}, \ldots L_M$.

Upon receiving a selection signal and a horizontal clock pulse signal, the D flip flop $b_1$ supplies an output equivalent to the selection signal to the following D flip flop $b_{K+1}$ simultaneously as it supplies rewrite signal to the scanning electrode $L_1$. The D flip flop $b_{K+1}$, on receiving the signal output from the D flip flop $b_1$, and a horizontal clock pulse signal Cl, outputs rewrite signal to the scanning electrode $L_{K+1}$ and simultaneously supplies an output equivalent to the selection signal to the following D flip flop. Through the repetition of this operation, the scanning electrodes of the same order in all groups are rewritten sequentially in the same frame period.

As a result, the lines $L_1, L_{K+1}, \ldots$ are rewritten in the first frame, the lines $L_2, L_{K+2}, \ldots$ are rewritten in the second frame, and the lines $L_K, L_{2K}, \ldots$ are rewritten in the Kth frame. Thus all the effective scanning lines are rewritten in K frames, as indicated partly by the signal driver output D in FIG. 2. With $K=2$, all the effective scanning lines are rewritten in two frames, the scanning lines of an odd number being rewritten in the first frame and the scanning lines of an even number being rewritten in the second frame.

Figure 3:
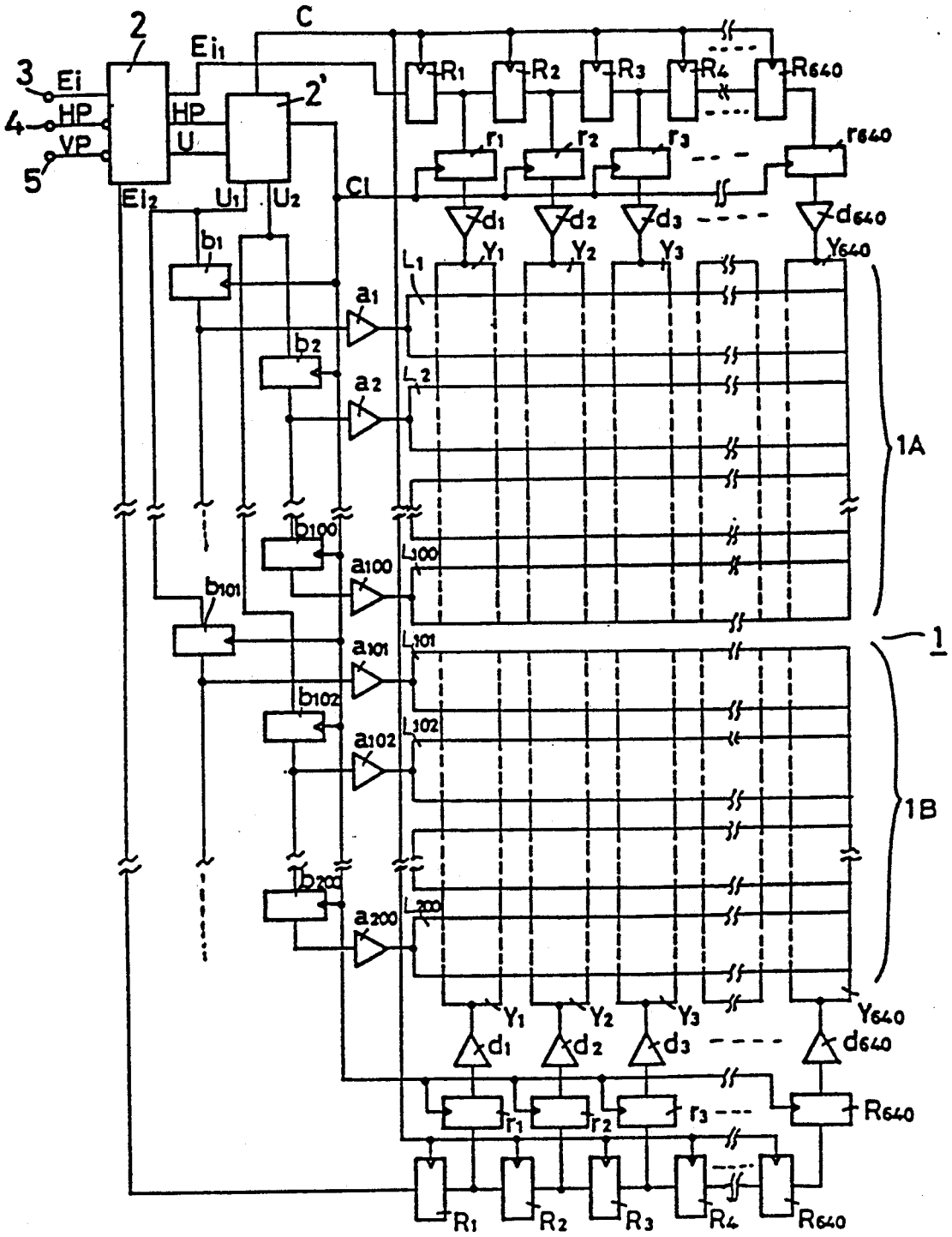
FIG. 3 is a circuit diagram showing the construction of the display device of a second embodiment of the invention.

FIG. 3 shows an example in which the present invention is applied to a split X-Y matrix type liquid crystal display panel 1. In this second embodiment, the display panel is divided into a first block 1A and a second block 1B. The first and second display block 1A and 1B are driven under the same condition as described later. The number of scanning electrodes in the effective display region is M, with M' pcs. in the first display block 1A and M' pcs. in the second display block 1B. The M' scanning electrodes in each of the first and second display blocks 1A and 1B are divided into P' groups each containing K' electrodes.

In the display device of this construction, the first scanning electrode of each group is scanned first, and the second scanning electrode of each group is scanned next. This process is repeated until the K'th electrode of each group is scanned. In other words, 2 P' scanning electrodes are scanned in each time period, and the scanning operation is conducted K' times to rewrite the picture on an entire display panel divided into the first and the second display blocks.

The action of the display device of the second embodiment shown in FIG. 3 is described assuming the number of scanning electrodes M=200, the number of scanning electrodes in each of the first and second display blocks M'=100, and the number of signal electrodes N=640. In each of the first and second display blocks, the scanning electrodes are divided into groups each containing K' electrodes. In this example, K'=2. Therefore, the scanning lines of an even number and the scanning lines of an odd number are scanned separately.

A hundred scanning electrodes $L_1, L_2, \ldots L_{100}$ are arranged in the first display block 1A, and a hundred scanning electrodes $L_{101}, L_{102}, \ldots L_{200}$ are arranged in the second display block 1B. Both the first and the second display blocks 1A and 1B have 640 signal electrodes $Y_1, Y_2, \ldots Y_{640}$. Ferrodielectric liquid crystal is used as a liquid crystal layer for each of the display blocks 1A and 1B.

Figure 4:
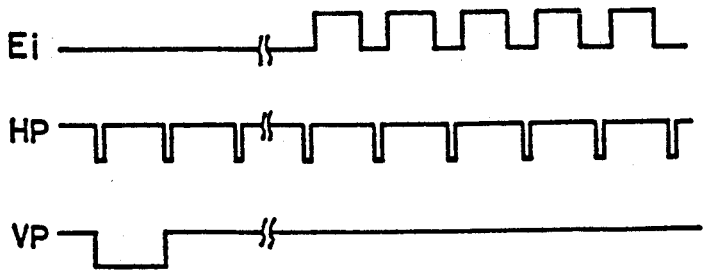
FIGS. 4 and 5 are charts of signal waveform in each part thereof.

Signal electrode drivers $d_1, d_2, \ldots d_{640}$ and D flip flops $r_1, r_2, \ldots r_{640}$ and $R_1, R_2, \ldots R_{640}$ for registers are basically the same as those for the first embodiment shown in FIG. 1. These elements are provided for the first and the second display blocks 1A and 1B independently. Image input signals Ei, horizontal synchronizing pulses HP and vertical synchronizing pulses VP as shown in FIG. 4 are input from a personal computer to terminals 3, 4 and 5, respectively. On the basis of these signal inputs, a first converter circuit 2 outputs image data signals $Ei_1$ and $Ei_2$, horizontal synchronizing pulses HP and basic selection pulses U shown in FIG. 5. The image data signals $Ei_1$ are supplied to the D flip flop $R_1$ for the first display block 1A, and the image data signals $Ei_2$ are supplied to the D flip flop $R_1$ for the second display block 1B.

Figure 5:
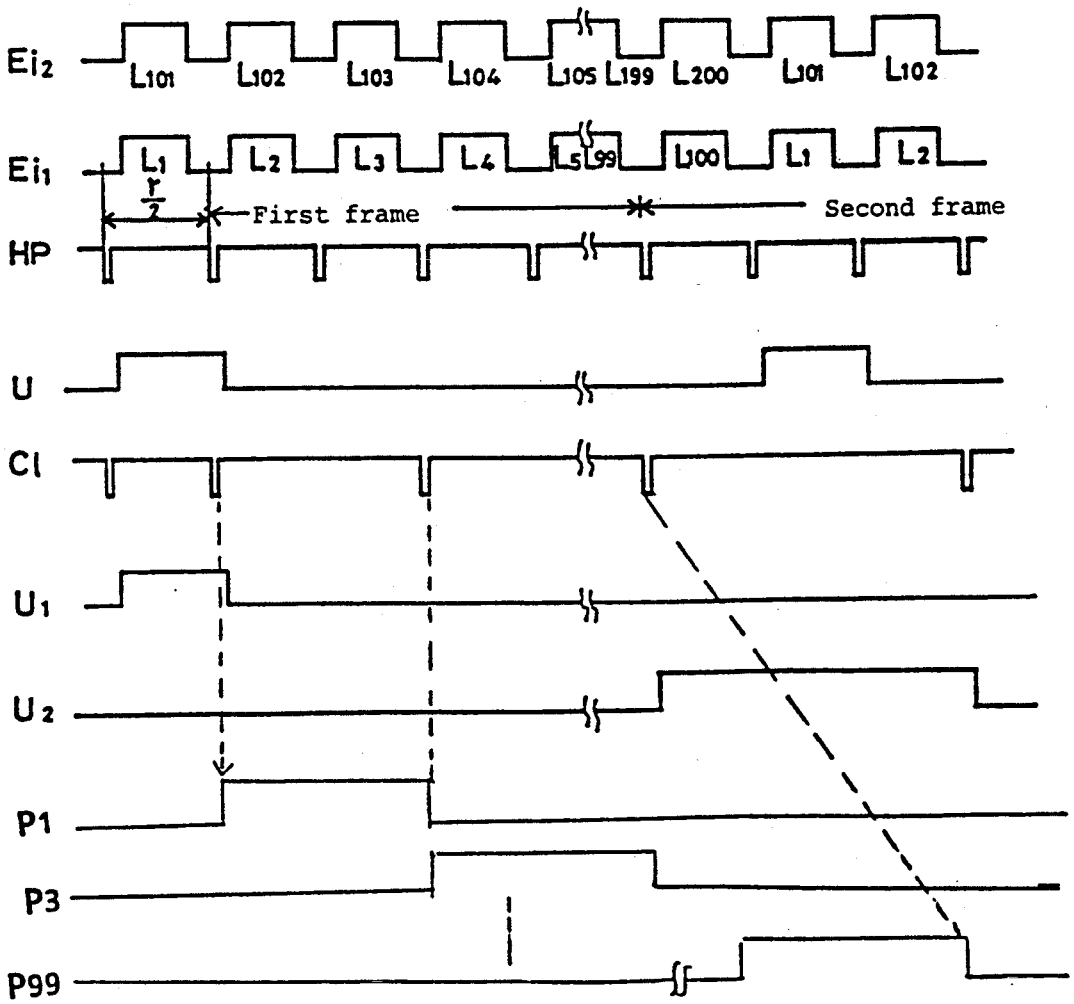

On the basis of the horizontal synchronizing pulses HP and the basic selection pulses U, a second converter circuit 2' generates basic clock pulse signals c, horizontal clock pulse signals cl and selection signals $U_1$ and $U_2$. In the present embodiment, the first and second converter circuit 2 and 2' are provided separately. They may be combined in one circuit. Outputs from the first and second converter circuits 2 and 2' are shown in FIG. 5.

Referring to FIG. 3, the selection signals $U_1$ are supplied to D flip flops $b_1$ and $b_{101}$, and the selection signals $U_2$ to D flip flops $b_2$ and $b_{102}$. The output from the D flip flop $b_1$, is given to the first scanning electrode $L_1$ via a scanning electrode driver $a_1$. The output from the D flip flop $b_{101}$ is given to the scanning electrode $L_{101}$ in the second display block 1B via a scanning electrode driver $a_{101}$. D flip flops $b_3, b_5 \ldots b_{99}$ are connected in series after the D flip flop $b_1$, but they are not shown in FIG. 3. The outputs from the D flip flops $b_3, b_5, \ldots b_{99}$ are connected via scanning electrode drivers $a_3, a_5, \ldots a_{99}$ to the scanning electrodes $L_3, L_5, \ldots L_{99}$ in the first display block 1A. Similarly, D flip flops $b_{103}, b_{105}, \ldots b_{199}$ are connected in series after the D flip flop $b_{101}$, although they are not shown. The outputs from the D flip flops $b_{103}, b_{105}, \ldots b_{199}$ are connected via scanning electrode drivers $a_{103}, a_{105}, \ldots a_{199}$ to the scanning electrodes $L_{103}, L_{105}, \ldots L_{199}$ in the second display block 1B.

The second selection signals $U_2$ are provided to D flip flops $b_2$ and $b_{102}$. Similarly, D flip flops $b_4, b_6, \ldots b_{100}$ are connected in series after the D flip flop $b_2$, and D flip flops $b_{104}, b_{106}, \ldots b_{200}$ after the D flip flop $b_{102}$. The D flip flops $b_2, b_{100}, b_{102}$ and $b_{200}$ drive the scanning electrodes $L_2, L_{100}, L_{102}$ and $L_{200}$ through the scanning electrode drivers $a_2, a_{100}, a_{102}$ and $a_{200}$, respectively, as shown in FIG. 3. The D flip flops $b_4, b_6, \ldots b_{99}$ and $b_{104}, b_{106}, \ldots b_{198}$ drive the corresponding scanning electrodes in the same manner as the above but the description thereof is omitted here. The clock pulse signal inputs to the scanning electrodes from the D flip flops $b_1, \ldots b_{200}$ are horizontal clock pulse signals cl generated by the second converter circuit 2', and the clock pulse signal inputs to the signal electrodes from the D flip flops $r_1, r_2, \ldots r_{640}$ are also the horizontal clock pulse signals cl.

In the first frame, selection signals $U_1$ are supplied to the data terminals of the D flip flops $b_1$ and $b_{101}$. On the basis of the selection signals and the horizontal clock pulse signals cl supplied as clock pulse signal inputs, the D flip flops $b_1$ and $b_{101}$, supply the scanning electrodes $L_1$ and $L_{101}$ with the output $P_1$ shown in FIG. 5. The outputs $P_1$ are also input to the data terminals of the following D flip flops $b_3$ and $b_{103}$ (not shown). On the basis of the signal input $P_1$ and the horizontal clock pulse signals cl supplied as clock pulse signal inputs, the D flip flops $b_3$ and $b_{103}$ output signals $P_3$ of FIG. 5 to the scanning electrodes $L_3$ and $L_{103}$. The similar pulses are output from the subsequent D flip flops to the corresponding scanning electrodes, and in the end of the first frame, the outputs from the D flip flops $b_{97}$ and $b_{197}$ are input to the data terminals and horizontal clock pulse signals to the clock terminals of the D flip flops $b_{99}$ and $b_{199}$, which then supply the scanning electrodes $L_{99}$ and $L_{199}$ with signals $P_{99}$ shown in FIG. 5. Thus, the first scanning electrodes of all groups are rewritten. In other words, rewrite signals are output to all the scanning electrodes of an odd number in the first frame.

In the second frame, similar pulses are output from the D flip flops related to the second scanning electrodes of the groups, namely to the scanning electrodes of an even number. The duration of the pulses $P_1, P_3, \ldots P_{99}$ is set at "r" sec. (about 200 μs in this embodiment) which is needed by liquid crystal to rewrite picture elements. "r/2" shown for the image data signal Ei in FIG. 5 is 100 μs in this embodiment.

Referring to FIG. 5, in the duration of the pulse $P_1$, for example, the D flip flops $r_1, r_2, \ldots r_{640}$ for the signal electrodes output signals to the first scanning line in the first display block 1A and to the 101st scanning line in the second display block 1B. Therefore, the scanning line $L_1$ and $L_{101}$ are rewritten in the duration of the pulse $P_1$. Similarly, the scanning lines $L_3$ and $L_{103}$ are rewritten in the duration of the pulse $P_3$. Thus, the scanning lines of an odd number $L_1, L_3, \ldots L_{99}$, and $L_{101}, L_{103}, \ldots L_{199}$ are written in the first frame, and the scanning lines of an even number $L_2, L_4, \ldots L_{100}$, and $L_{102}, L_{104}, \ldots L_{200}$ are rewritten in the second frame. In the third frame, the same scanning electrodes as in the first frame are rewritten.

In the second embodiment shown in FIG. 3, the number of scanning electrodes in each group K' is assumed to be 2 so that a picture is completed in two frames. It should be understood that the second embodiment shown in FIG. 3 can be modified easily to set K' to any desired value other than 2.

The effect of the present invention with K (or K')=2 as shown in FIGS. 1 and 3 is explained with reference to FIG. 6. When a figure "1" is kept written on the display screen, the luminance of the figure on the scanning electrodes $L_1$, $L_2$, $L_3$ and $L_4$ is shown in FIGS. 6(1), 6(2), 6(3) and 6(4). The combined luminance of the 4 (vertical)×4 (horizontal) picture elements is shown in FIG. 6(5). It means that the apparent frequency for rewriting the entire image is 50 Hz although each scanning line is rewritten at 25 Hz. According to the present invention, therefore, flicker decreases and the picture quality improves compared with the picture of the conventional device in which an entire picture is rewritten at 25 Hz. With K=2, every other scanning line is rewritten in each frame. With K=3, every third line is rewritten in each frame.

According to the present invention, as mentioned above, the display device, which provides an incomplete memory characteristic and takes a specified time to rewrite the picture elements in one horizontal scanning period, decreases flicker by increasing the apparent speed of rewriting the picture elements. This results in improved picture quality.

In the above embodiments of the present invention, it is assumed that the number of effective scanning lines in the effective display region is M. The total number of scanning lines in the display device may be greater than M. For M=200, for instance, the total number of scanning line may be, say, 262.

While only certain embodiments of the present invention have been described, it will be apparent to those skilled in the art that various changes and modifications may be made therein without departing from the spirit and scope of the present invention as claimed.

What is claimed is:

1. A display device for receiving a non-interlaced image signal and displaying the received non-interlaced image signal by an interlaced scanning method, said device taking a specified period to rewrite the picture elements in one horizontal scanning period, said device comprising:

a matrix type liquid crystal display panel containing a ferrodielectric liquid crystal;

M scanning lines disposed on the display panel and divided into a plurality of groups, each containing K scanning lines, wherein K and M are integers greater than 1; and supplying means for supplying scanning signals to the M scanning lines to rewrite said non-interlaced image signal, said supplying means including selection means for sequentially outputting K select signals, delay means for successively delaying each of the K select signals, and means for successively applying each sequentially output K select signal, successively delayed, to corresponding scanning lines of each of the plurality of groups, whereby a scanning signal is outputted to the first scanning line of each group in the first frame, to the second scanning line of each group in the second frame, and to the Kth scanning line of each group in the Kth frame so that picture elements on the M scanning lines are rewritten by K times of scanning, thereby said received non-interlaced image signal being displayed on said display panel at a field frequency within the frame frequency K times larger than that of said received non-interlaced image signal.

2. The display device as claimed in claim 1, wherein the specified period required for rewritting picture elements in one horizontal scanning period is r, and the display device satisfies the condition of $$60\ \text{Hz} > \frac{1}{r \times M}.$$

3. The display device, as claimed in claim 1, where the display device is used in a personal computer.

4. A display device for receiving a non-interlaced image signal and displaying the received non-interlaced image signal by an interlaced scanning method, said device comprising:

a matrix type liquid crystal display panel interposing a ferroelectric liquid crystal between plural scanning electrodes and plural signal electrodes which are arranged in directions intersecting each other, the ferroelectric liquid crystal constituting picture elements at intersections of the plural scanning electrodes and the plural signal electrodes, the picture elements having memory characteristics without any active-matrix driving elements;

M scanning electrodes disposed on the display panel and divided into a plurality of groups, each containing K scanning electrodes, wherein K and M are integers greater than 1; and supplying means for supplying scanning signals to drivers connected to the M scanning electrodes to rewrite data corresponding to said non-interlaced image signal, said supplying means including selecting means for selecting corresponding one scanning electrode of each of said groups in a given field period, so as to select successively K scanning electrodes of each group in K successive field periods, and means for applying a selective voltage successively to a selected scanning electrode of each group and applying a non-selective voltage to non-selected scanning electrodes of each group, whereby the selective voltage is applied to the first scanning electrode of each group in a first field period, to the second scanning electrode of each group in a second field period, and to the Kth scanning electrode of each group in a Kth field period so that picture elements on the M scanning electrodes are rewritten by a frame period which is K times larger than said field period, thereby said received non-interlaced image signal being displayed on said display panel at a field frequency which is K times larger than a frame frequency.

5. A display device as claimed in claim 4, wherein said selecting means includes outputting means for sequentially outputting K select signals successively delayed, and wherein said applying means includes means for successively applying each sequentially output K select signal, successively delayed, to corresponding scanning lines of each of the plurality of groups.

6. A display device as claimed in claim 5, wherein said outputting means includes means for sequentially outputting K select signals, and delay means for successively delaying each of the K select signals.

* * * * *